US011423817B2

(12) United States Patent
Jung

(10) Patent No.: US 11,423,817 B2
(45) Date of Patent: Aug. 23, 2022

(54) DISPLAY DEVICE, AND METHOD OF OPERATING A DISPLAY DEVICE

(71) Applicant: Samsung Display Co., Ltd., Yongin-Si (KR)

(72) Inventor: Sung Gon Jung, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/357,308

(22) Filed: Jun. 24, 2021

(65) Prior Publication Data

US 2022/0189363 A1 Jun. 16, 2022

(30) Foreign Application Priority Data

Dec. 10, 2020 (KR) ..... 10-2020-0172385

(51) Int. Cl.
*G09G 3/20* (2006.01)

(52) U.S. Cl.
CPC ..... *G09G 3/20* (2013.01); *G09G 3/2092* (2013.01); *G09G 2310/04* (2013.01); *G09G 2310/08* (2013.01); *G09G 2320/103* (2013.01); *G09G 2330/021* (2013.01); *G09G 2340/0435* (2013.01); *G09G 2340/16* (2013.01)

(58) Field of Classification Search
None
See application file for complete search history.

(56) References Cited

U.S. PATENT DOCUMENTS 6,831,617 B1 * 12/2004 Miyauchi ..... G09G 3/3666 345/38
9,196,222 B2 11/2015 Moon et al.
10,665,168 B2 * 5/2020 Park ..... G09G 3/3233
2007/0229664 A1 * 10/2007 Nagaoka ..... H04N 7/0122 348/E5.073
2015/0146097 A1 * 5/2015 Izumi ..... H04N 21/440218 348/447
2015/0170607 A1 * 6/2015 Shin ..... G09G 3/20 345/690

FOREIGN PATENT DOCUMENTS

KR 10-2015-0069850 A 6/2015
KR 10-2016-0124360 A 10/2016
KR 10-2017-0109135 A 9/2017

* cited by examiner

*Primary Examiner* — Dorothy Harris
(74) *Attorney, Agent, or Firm* — Innovation Counsel LLP

(57) ABSTRACT

A display device includes a display panel and a panel driver. In a case where input image data represents a moving image with respect to a first partial region and represents a still image with respect to a second partial region, the panel driver performs a normal frequency driving operation on the first partial region, and performs a low frequency driving operation on the second partial region. In a standby mode, after the normal frequency driving operation and the low frequency driving operation are performed on the first partial region and the second partial region, respectively, the panel driver sets a portion of the second partial region adjacent to the first partial region as an adjacent region, performs the low frequency driving operation on the first partial region and the second partial region except for the adjacent region, and performs a variable frequency driving operation on the adjacent region.

20 Claims, 9 Drawing Sheets

| PXR | VF |
|---|---|
| PXR1 | 120Hz |
| PXR2 | 60Hz |
| PXR3 | 40Hz |
| PXR4 | 30Hz |
| PXR5 | 20Hz |
| PXR6 | 12Hz |
| PXR7 | 6Hz |
| PXR8 | 3Hz |
| PXR9 | 2Hz |
| PXR10 | 1Hz |

| PXR | VF |
|---|---|
| PXR1 and PXR2 | 120Hz |
| PXR3 and PXR4 | 40Hz |
| PXR5 and PXR6 | 20Hz |
| PXR7 and PXR8 | 6Hz |
| PXR9 and PXR10 | 2Hz |

DISPLAY DEVICE, AND METHOD OF OPERATING A DISPLAY DEVICE

CROSS-REFERENCE TO RELATED APPLICATION(S)

This application claims priority under 35 USC § 119 to Korean Patent Application No. 10-2020-0172385, filed on Dec. 10, 2020 in the Korean Intellectual Property Office (KIPO), the entire content of which is incorporated by reference herein in its entirety.

BACKGROUND

1. Field

The present disclosure relates to a display device, and more particularly to a display device that performs multi-frequency driving (MFD), and a method of operating the same.

2. Description of the Related Art

Reduction of power consumption is desirable in a display device employed in a portable device, such as a smartphone, a tablet computer, etc. Recently, in order to reduce the power consumption of the display device, a low frequency driving technique which drives or refreshes a display panel at a frequency lower than a normal driving frequency has been developed.

However, in a conventional display device to which the low frequency driving technique is applied, when a still image is not displayed in an entire region of a display panel, or when the still image is displayed only in a partial region of the display panel, the entire region of the display panel is driven at the normal driving frequency. Thus, in this case, the low frequency driving may not be performed, and the power consumption may not be reduced.

To reduce the power consumption even in the case where the still image is displayed only in the partial region of the display panel, a multi-frequency driving (MFD) technique which drives partial regions of the display panel at different driving frequencies. In a display device to which the MFD technique is applied, a first partial region in which a moving image is displayed may be driven at the normal driving frequency, and a second partial region in which a still image is displayed may be driven at a frequency lower than the normal driving frequency. Accordingly, the power consumption may be reduced even in the case where the still image is displayed only in the partial region of the display panel. However, in the display device to which the MFD technique is applied, a boundary between the partial regions driven at the different driving frequencies may be viewed or perceived by a user.

SUMMARY

Some embodiments provide a display device capable of preventing a boundary between partial regions driven at different driving frequencies from being viewed or perceived by a user.

Some embodiments provide a method of operating a display device capable of preventing a boundary between partial regions driven at different driving frequencies from being viewed or perceived by a user.

According to embodiments, there is provided a display device including a display panel having a display region, and a panel driver configured to drive the display panel based on input image data. In a case where the input image data represents a moving image with respect to a first partial region of the display region and represents a still image with respect to a second partial region of the display region, the panel driver performs a normal frequency driving operation on the first partial region, and performs a low frequency driving operation on the second partial region. In a standby mode after the normal frequency driving operation and the low frequency driving operation are performed on the first partial region and the second partial region, respectively, the panel driver sets a portion of the second partial region adjacent to the first partial region as an adjacent region, performs the low frequency driving operation on the first partial region and the second partial region except for the adjacent region, and performs a variable frequency driving operation on the adjacent region.

In embodiments, the variable frequency driving operation for the adjacent region may drive the adjacent region at a variable frequency that gradually decreases from a normal driving frequency to a low frequency along a direction from the first partial region to the second partial region.

In embodiments, the variable frequency may decrease per a pixel row of the adjacent region.

In embodiments, the variable frequency may decrease per N pixel rows of the adjacent region, where N is an integer greater than 0.

In embodiments, the normal frequency driving operation for the first partial region may drive the first partial region at a normal driving frequency, the low frequency driving operation for the second partial region may drive the second partial region at a low frequency lower than the normal driving frequency, and the low frequency driving operation for the first partial region and the second partial region except for the adjacent region may drive the first partial region and the second partial region except for the adjacent region at the low frequency.

In embodiments, a size of the adjacent region may be determined based on an adjacent region size parameter.

In embodiments, the standby mode may be an always on display (AOD) mode or a mode in which a black image is displayed.

In embodiments, the panel driver may include a still image detector configured to detect the still image in an image represented by the input image data by analyzing the input image data.

In embodiments, the panel driver may further include a driving frequency decider configured to determine a driving frequency for the first partial region determined by the still image detector to display the moving image as a normal driving frequency, and to determine a driving frequency for the second partial region determined by the still image detector to display the still image as a low frequency lower than the normal driving frequency.

In embodiments, in the standby mode, the driving frequency decider may set the portion of the second partial region adjacent to the first partial region as the adjacent region, may determine a driving frequency for the first partial region and the second partial region except for the adjacent region as the low frequency, and may determine a driving frequency for the adjacent region as a variable frequency that gradually decreases from the normal driving frequency to the low frequency along a direction from the first partial region to the second partial region.

In embodiments, a time length of a second time during which the variable frequency driving operation is performed on the adjacent region may be substantially equal to a time length of a first time during which the normal frequency driving operation and the low frequency driving operation are respectively performed on the first partial region and the second partial region.

In embodiments, the panel driver may include a counter configured to increase a count value from an initial value for a first time during which the normal frequency driving operation and the low frequency driving operation are respectively performed on the first partial region and the second partial region.

In embodiments, the counter may decrease the count value increased for the first time to the initial value in the standby mode. In the standby mode, the panel driver may perform the variable frequency driving operation on the adjacent region until the count value reaches the initial value, and may perform the low frequency driving operation on an entire region of the display region after the count value reaches the initial value.

In embodiments, the counter may stop decreasing the count value when the standby mode is exited before the count value increased for the first time reaches the initial value, and may resume decreasing the count value when the standby mode is re-entered.

According to embodiments, there is provided a method of operating a display device including a display panel having a display region. In the method, a normal frequency driving operation is performed on a first partial region of the display region in a case where input image data represents a moving image with respect to the first partial region, a low frequency driving operation is performed on a second partial region of the display region in a case where the input image data represents a still image with respect to the second partial region, a portion of the second partial region adjacent to the first partial region is set as an adjacent region in a standby mode after the normal frequency driving operation and the low frequency driving operation are performed on the first partial region and the second partial region, respectively, the low frequency driving operation is performed on the first partial region and the second partial region except for the adjacent region in the standby mode, and a variable frequency driving operation is performed on the adjacent region in the standby mode.

In embodiments, to perform the variable frequency driving operation on the adjacent region, the adjacent region may be driven at a variable frequency that gradually decreases from a normal driving frequency to a low frequency along a direction from the first partial region to the second partial region.

In embodiments, to perform the normal frequency driving operation on the first partial region, the first partial region may be driven at a normal driving frequency. To perform the low frequency driving operation on the second partial region, the second partial region may be driven at a low frequency lower than the normal driving frequency. To perform the low frequency driving operation on the first partial region and the second partial region except for the adjacent region, the first partial region and the second partial region except for the adjacent region may be driven at the low frequency.

In embodiments, a time length of a second time during which the variable frequency driving operation is performed on the adjacent region may be substantially equal to a time length of a first time during which the normal frequency driving operation and the low frequency driving operation are respectively performed on the first partial region and the second partial region.

In embodiments, a count value may be increased from an initial value for a first time during which the normal frequency driving operation and the low frequency driving operation are respectively performed on the first partial region and the second partial region, and the count value increased for the first time may be decreased to the initial value in the standby mode. The variable frequency driving operation for the adjacent region may be performed until the count value reaches the initial value.

In embodiments, to decrease the count value to the initial value, decreasing the count value may be stopped when the standby mode is exited before the count value increased for the first time reaches the initial value, and decreasing the count value may be resumed when the standby mode is re-entered.

As described above, in a display device and a method of operating the display device according to embodiments, in a standby mode after a normal frequency driving operation and a low frequency driving operation are performed on a first partial region and a second partial region, respectively, a portion of the second partial region adjacent to the first partial region may be set as an adjacent region, the low frequency driving operation may be performed on the first partial region and the second partial region except for the adjacent region, and a variable frequency driving operation may be performed on the adjacent region. Accordingly, even if the first and second partial regions are driven at different driving frequencies, a boundary between the first and second partial regions may be prevented from being viewed or perceived by a user.

BRIEF DESCRIPTION OF THE DRAWINGS

Illustrative, non-limiting embodiments will be more clearly understood from the following detailed description in conjunction with the accompanying drawings.

DETAILED DESCRIPTION OF THE EMBODIMENTS

Hereinafter, embodiments of the present disclosure will be explained in detail with reference to the accompanying drawings.

Figure 1:
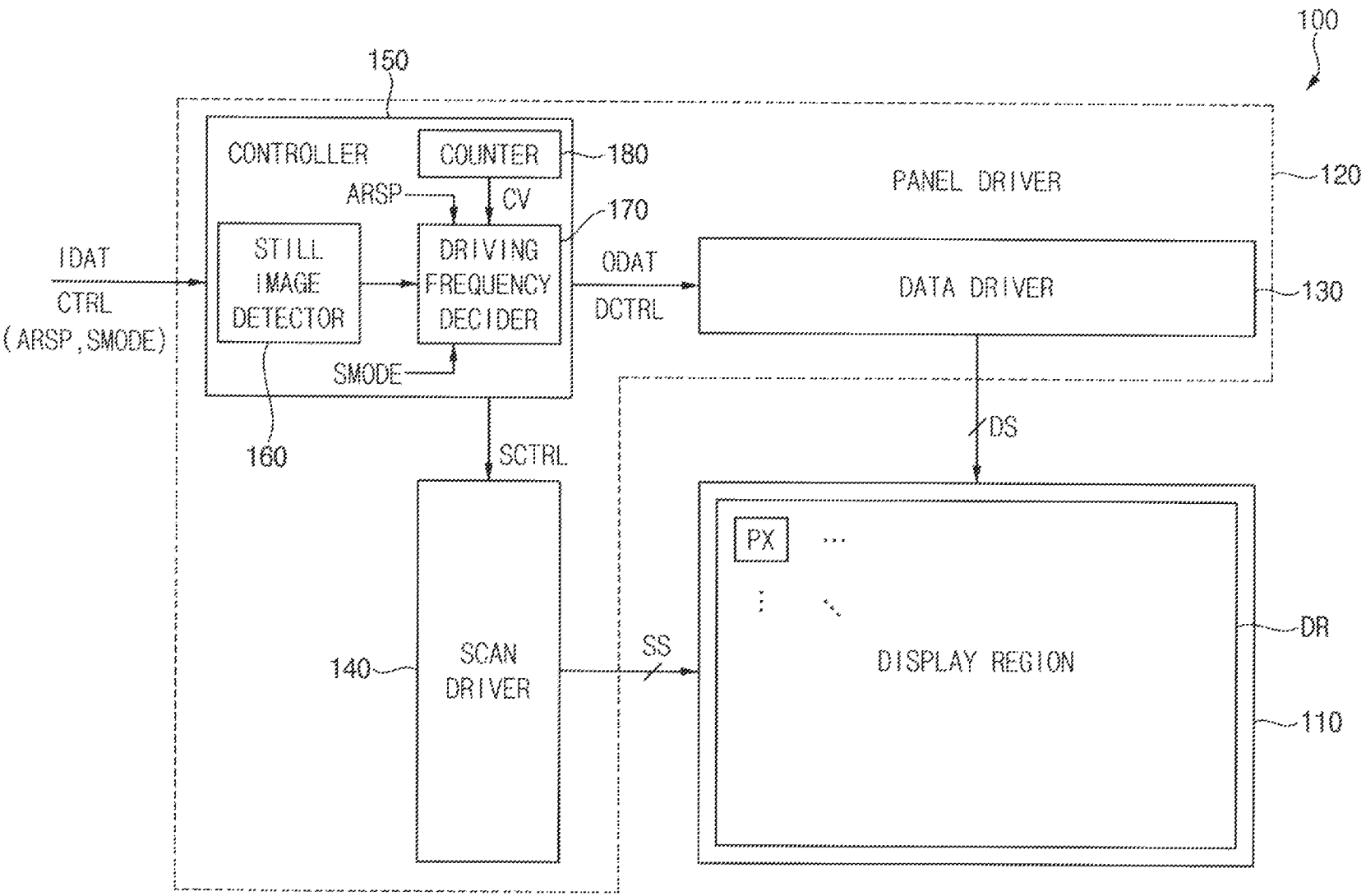
FIG. 1 is a block diagram illustrating a display device according to embodiments.
Figure 2:
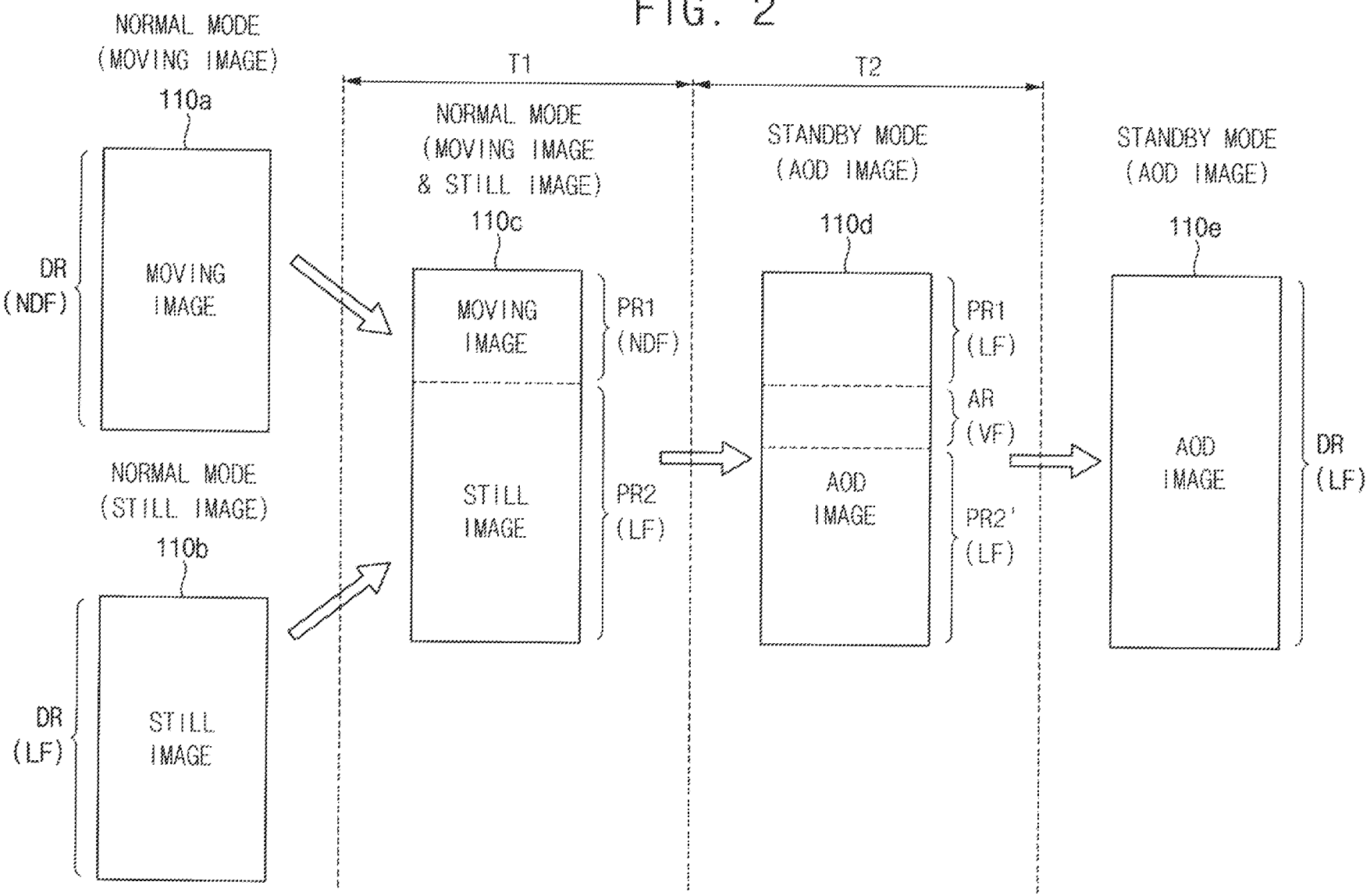
FIG. 2 is a diagram for describing an example of an operation of a display device according to embodiments.
Figure 3:
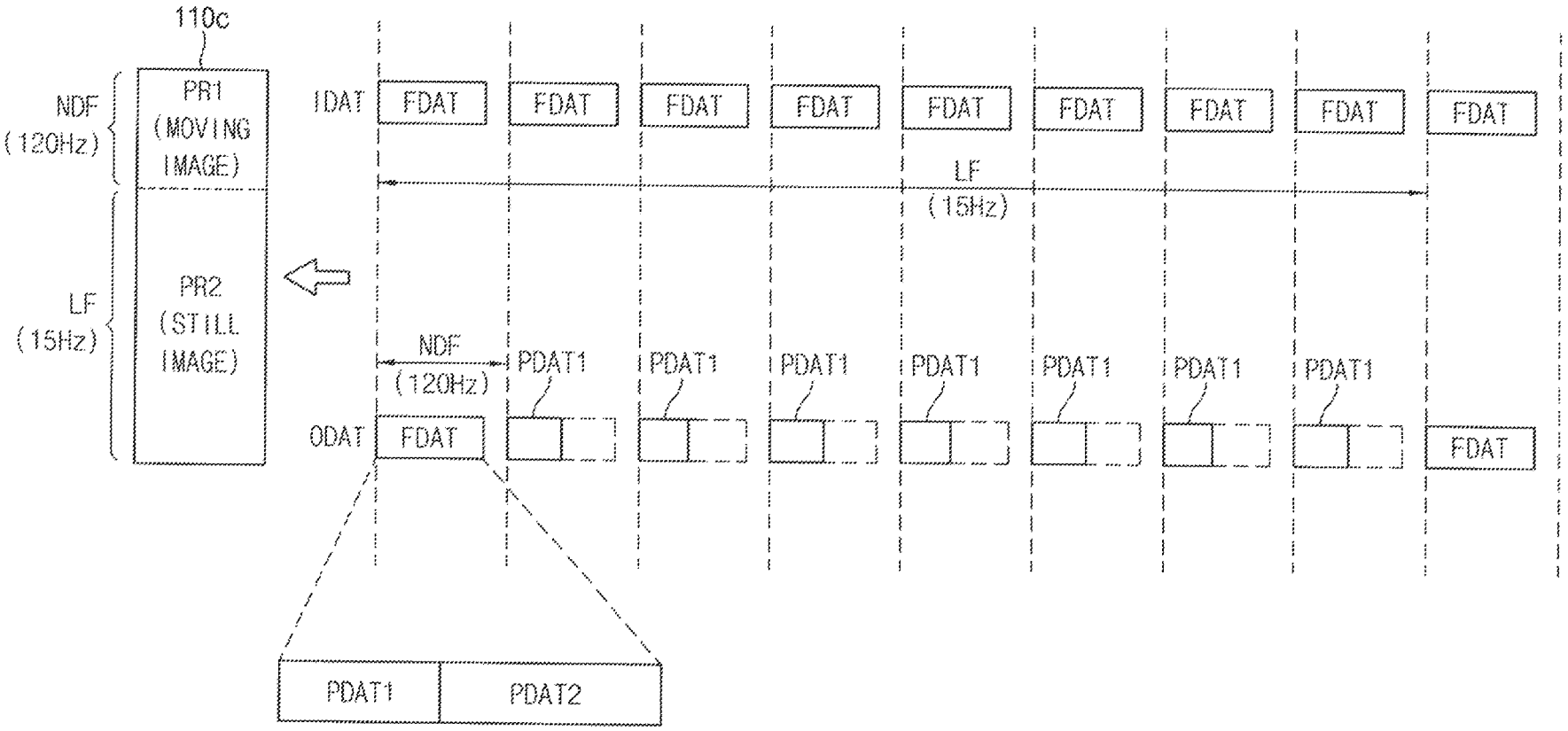
FIG. 3 is a diagram for describing an example where a normal frequency driving operation is performed on a first partial region and a low frequency driving operation is performed on a second partial region.
Figure 4:
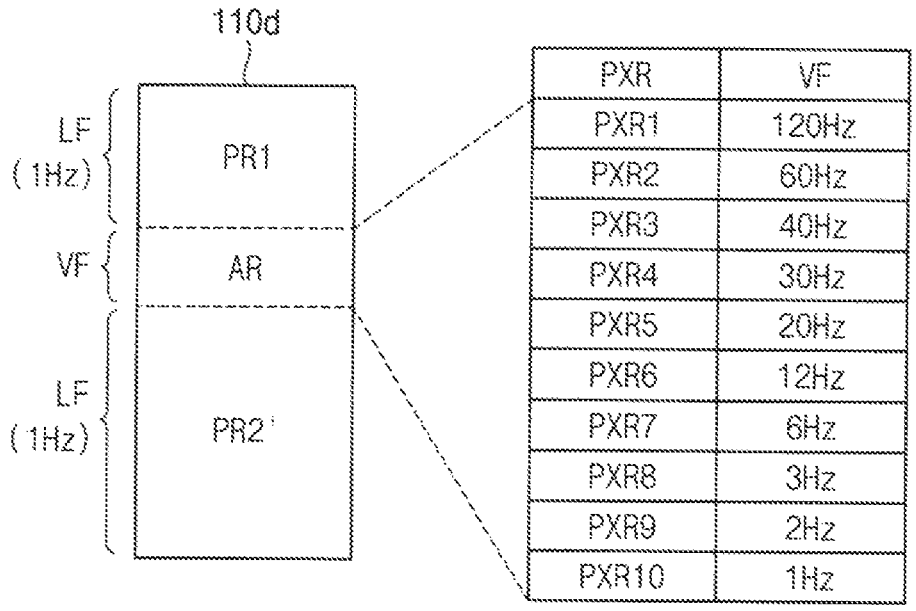
FIG. 4 is a diagram for describing an example of a variable frequency of an adjacent region.
Figure 5:
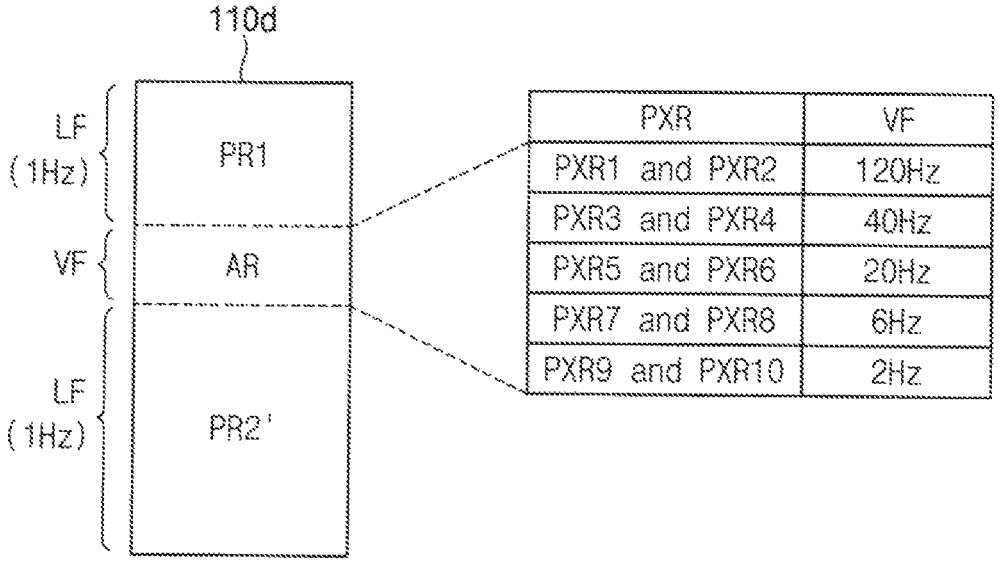
FIG. 5 is a diagram for describing another example of a variable frequency of an adjacent region.
Figure 6:
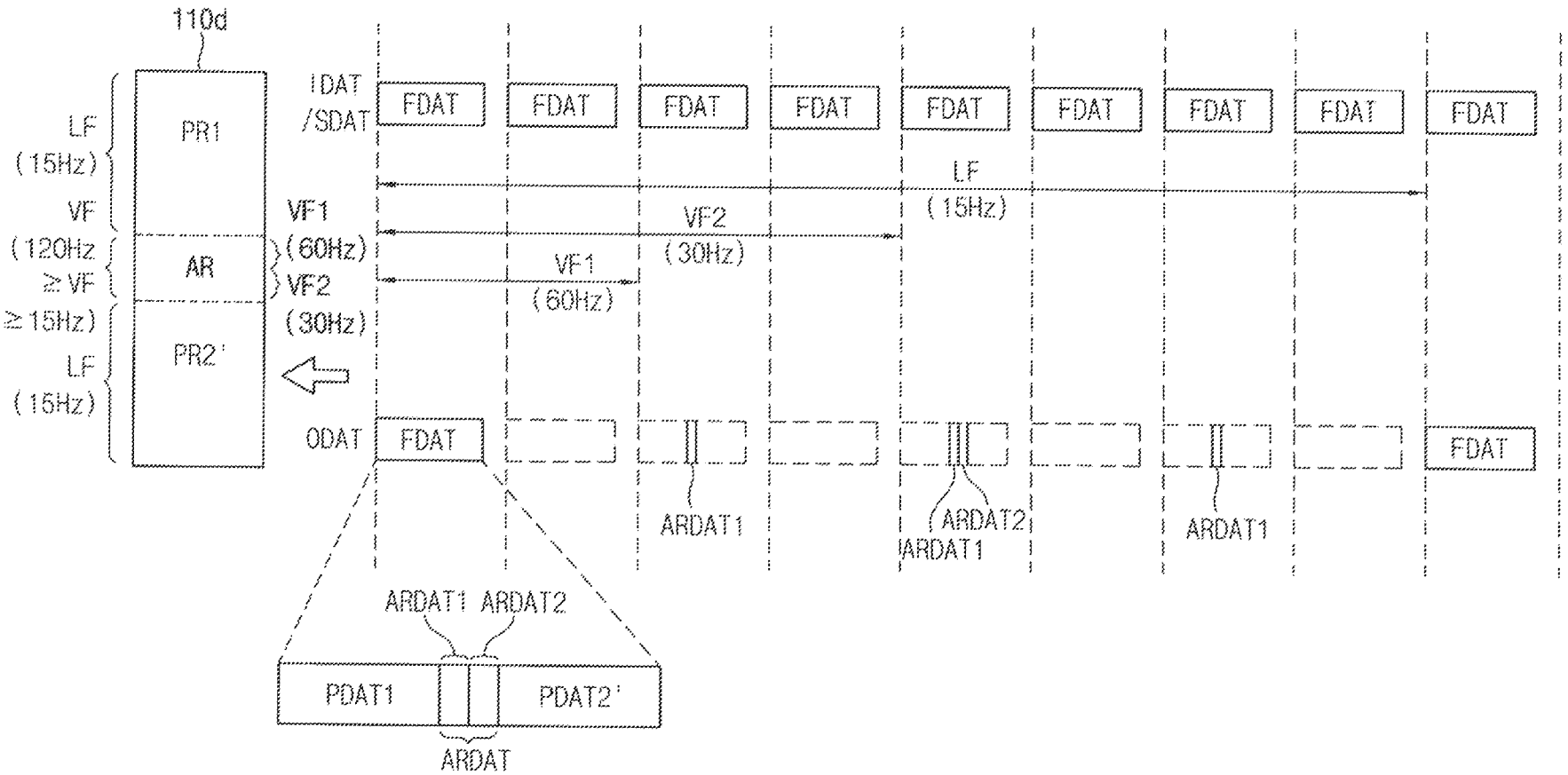
FIG. 6 is a diagram for describing an example where, in a standby mode, a variable frequency driving operation is performed on an adjacent region and a low frequency driving operation is performed on the remaining region.

FIG. 1 is a block diagram illustrating a display device according to embodiments, FIG. 2 is a diagram for describing an example of an operation of a display device according to embodiments, FIG. 3 is a diagram for describing an example where a normal frequency driving operation is performed on a first partial region and a low frequency driving operation is performed on a second partial region, FIG. 4 is a diagram for describing an example of a variable frequency of an adjacent region, FIG. 5 is a diagram for describing another example of a variable frequency of an adjacent region, and FIG. 6 is a diagram for describing an example where, in a standby mode, a variable frequency driving operation is performed on an adjacent region and a low frequency driving operation is performed on the remaining region.

Referring to FIG. 1, a display device 100 according to embodiments may include a display panel 110 having a display region DR, and a panel driver 120 that drives the display panel 110 based on input image data IDAT provided from an external source. In some embodiments, the panel driver 120 may include a data driver 130 that provides data signals DS to the display panel 110, a scan driver 140 that provides scan signals SS to the display panel 110, and a controller 150 that controls an operation of the display device 100.

The display panel 110 may include the display region DR in which a plurality of pixels PX is formed. The display panel 110 may further include a plurality of data lines connected to the data driver 130, a plurality of scan lines connected to the scan driver 140, and the plurality of pixels PX coupled to the plurality of data lines and the plurality of scan lines. In some embodiments, each pixel PX may include at least one capacitor, at least two transistors and an organic light emitting diode (OLED), and the display panel 110 may be an OLED display panel. In other embodiments, the display panel 110 may be a liquid crystal display (LCD) panel, or any other suitable display panel.

The data driver 130 may generate the data signals DS based on output image data ODAT and a data control signal DCTRL received from the controller 150, and may provide the data signals DS to the plurality of pixels PX through the plurality of data lines. In some embodiments, the data control signal DCTRL may include, but not be limited to, an output data enable signal, a horizontal start signal and a load signal. In some embodiments, the data driver 130 and the controller 150 may be implemented with a single integrated circuit, and the single integrated circuit may be referred to as a timing controller embedded data driver (TED). In other embodiments, the data driver 130 and the controller 150 may be implemented with separate integrated circuits.

The scan driver 140 may generate the scan signals SS based on a scan control signal SCTRL received from the controller 150, and may sequentially provide the scan signals SS to the plurality of pixels PX on a row-by-row basis through the plurality of scan lines. In some embodiments, the scan control signal SCTRL may include, but not be limited to, a scan start signal, a scan clock signal, etc. In some embodiments, the scan driver 140 may be integrated or formed in a peripheral portion adjacent to the display region DR of the display panel 110. In other embodiments, the scan driver 140 may be implemented with one or more integrated circuits.

The controller (e.g., a timing controller (TCON)) 150 may receive the input image data IDAT and a control signal CTRL from an external host processor (e.g., a graphic processing unit (GPU), an application processor (AP) or a graphic card). In some embodiments, the control signal CTRL may include an adjacent region size parameter ARSP representing a size of an adjacent region (e.g., the number of pixel rows (or scan lines) in the adjacent region) on which a variable frequency driving operation is to be performed, and/or a mode signal SMODE representing whether an operation mode of the display device 100 is one of a normal mode, a standby mode or any other mode. In some embodiments, the control signal CTRL may further include, but not be limited to, a vertical synchronization signal, a horizontal synchronization signal, an input data enable signal, a master clock signal, etc. The controller 150 may generate the data control signal DCTRL, the scan control signal SCTRL and the output image data ODAT based on the control signal CTRL and the input image data IDAT. The controller 150 may control an operation of the data driver 130 by providing the output image data ODAT and the data control signal DCTRL to the data driver 130, and may control an operation of the scan driver 140 by providing the scan control signal SCTRL to the scan driver 140.

The panel driver 120 of the display device 100 according to embodiments may drive the entire display region DR of the display panel 110 at a low frequency lower than a normal driving frequency (e.g., about 60 Hz, about 120 Hz, about 144 Hz, etc.) when a still image is displayed in the entire display region DR of the display panel 110. Further, when a still image is displayed only in a portion of the display region DR of the display panel 110, the panel driver 120 may drive the portion of the display region DR at the low frequency, and may drive the remaining portion of the display region DR at the normal driving frequency. Thus, the panel driver 120 of the display device 100 according to embodiments may perform multi-frequency driving (MFD) that drives partial regions of the display region DR at different driving frequencies. To perform this operation, in some embodiments, the controller 150 of the panel driver 120 may include a still image detector 160 that detects the still image in an image represented by the input image data IDAT by analyzing the input image data IDAT, and a driving frequency decider 170 that determines a driving frequency for a first partial region of the display region DR determined by the still image detector 160 to display a moving image as the normal driving frequency, and determines a driving frequency for a second partial region of the display region DR determined by the still image detector 160 to display the still image as the low frequency lower than the normal driving frequency.

In an example where a moving image is displayed in the entire display region DR of a display panel 110*a* as illustrated in FIG. 2, the panel driver 120 may drive the entire display region DR of the display panel 110*a* at a normal driving frequency NDF. In some embodiments, the normal driving frequency NDF may be a driving frequency or a refresh rate that is previously determined with respect to the display device 100, and may be, but not be limited to, one of about 60 Hz, about 120 Hz, about 144 Hz, or any other frequency. For example, the still image detector 160 may compare the input image data IDAT in a previous frame and the input image data IDAT in a current frame, may determine that the input image data IDAT represent the moving image with respect to the entire display region DR of the display panel 110*a*, or that the entire display region DR of the display panel 110*a* displays the moving image in a case where the input image data IDAT in the previous frame and the input image data IDAT in the current frame are different from each other. The driving frequency decider 170 may determine a driving frequency for the entire display region DR of the display panel 110*a* determined by the still image detector 160 to display the moving image as the normal driving frequency NDF. The panel driver 120 may perform a normal frequency driving operation on the entire display region DR of the display panel 110*a*. Thus, the panel driver 120 may drive the entire display region DR of the display panel 110*a* at the normal driving frequency NDF determined by the driving frequency decider 170.

In another example where a still image is displayed in the entire display region DR of a display panel 110*b* as illustrated in FIG. 2, the panel driver 120 may drive the entire display region DR of the display panel 110*b* at a low frequency LF lower than the normal driving frequency NDF. In some embodiments, the low frequency LF may be any frequency lower than the normal driving frequency NDF. For example, in a case where the normal driving frequency NDF is about 120 Hz, the low frequency LF may be, but not be limited to, about 1 Hz, about 2 Hz, about 3 Hz, . . . , about 60 Hz, or the like. For example, the still image detector 160 may compare the input image data IDAT in a previous frame and the input image data IDAT in a current frame, may determine that the input image data IDAT represent the still image with respect to the entire display region DR of the display panel 110*b*, or that the entire display region DR of the display panel 110*b* displays the still image in a case where the input image data IDAT in the previous frame and the input image data IDAT in the current frame are substantially the same as each other. The driving frequency decider 170 may determine a driving frequency for the entire display region DR of the display panel 110*b* determined by the still image detector 160 to display the still image as the low frequency LF. The panel driver 120 may perform a low frequency driving operation on the entire display region DR of the display panel 110*b*. Thus, the panel driver 120 may drive the entire display region DR of the display panel 110*b* at the low frequency LF determined by the driving frequency decider 170.

In still another example where a moving image is displayed in a first partial region PR1 of a display region DR of a display panel 110*c* and a still image is displayed in a second partial region PR2 of the display region DR of the display panel 110*c* as illustrated in FIG. 2, the panel driver 120 may drive the first partial region PR1 of the display panel 110*c* at the normal driving frequency NDF, and may drive the second partial region PR2 of the display panel 110*c* at the low frequency LF lower than the normal driving frequency NDF. Thus, the panel driver 120 may perform the MFD that drives the first and second partial regions PR1 and PR2 at different driving frequencies NDF and LF. For example, the still image detector 160 may determine that the input image data IDAT represent the moving image with respect to the first partial region PR1 of the display panel 110*c*, or that the first partial region PR1 of the display panel 110*c* displays the moving image in a case where the input image data IDAT for the first partial region PR1 in the previous frame and the input image data IDAT for the first partial region PR1 in the current frame are different from each other. Further, the still image detector 160 may determine that the input image data IDAT represent the still image with respect to the second partial region PR2 of the display panel 110*c*, or that the second partial region PR2 of the display panel 110*c* displays the still image in a case where the input image data IDAT for the second partial region PR2 in the previous frame and the input image data IDAT for the second partial region PR2 in the current frame are substantially the same as each other. In some embodiments, the still image detector 160 may determine whether each of the first partial region PR1 and the second partial region PR2 having fixed positions and fixed sizes displays the moving image or the still image. In other embodiments, the still image detector 160 may dynamically detect the first partial region PR1 (or a moving image region) and the second partial region PR2 (or a still image region) having variable positions and variable sizes in each frame by analyzing the input image data IDAT. The driving frequency decider 170 may determine a driving frequency for the first partial region PR1 of the display panel 110*c* determined by the still image detector 160 to display the moving image as the normal driving frequency NDF, and may determine a driving frequency for the second partial region PR2 of the display panel 110*c* determined by the still image detector 160 to display the still image as the low frequency LF lower than the normal driving frequency NDF. The panel driver 120 may perform the normal frequency driving operation on the first partial region PR1 of the display panel 110*c*, and may perform the low frequency driving operation on the second partial region PR2 of the display panel 110*c*. Thus, the panel driver 120 may drive the first partial region PR1 of the display panel 110*c* at the normal driving frequency NDF determined by the driving frequency decider 170, and may drive the second partial region PR2 of the display panel 110*c* at the low frequency LF determined by the driving frequency decider 170.

For example, as illustrated in FIG. 3, in a case where the first partial region PR1 is driven at the normal driving frequency NDF of about 120 Hz and the second partial region PR2 is driven at the low frequency LF of about 15 Hz, the controller 150 of the panel driver 120 may receive, as the input image data IDAT, frame data FDAT including first partial region data PDAT1 for the first partial region PR1 and second partial region data PDAT2 for the second partial region PR2 at an input frame frequency of about 120 Hz, may output, as the output image data ODAT, the first partial region data PDAT1 for the first partial region PR1 to the data driver 130 at the normal driving frequency NDF of about 120 Hz, and may output, as the output image data ODAT, the second partial region data PDAT2 for the second partial region PR2 to the data driver 130 at the low frequency LF of about 15 Hz. Thus, although the controller 150 receives eight frame data FDAT during eight frames, the controller 150 may output the first partial region data PDAT1 eight times during the eight frames, and may output the second partial region data PDAT2 only one time during the eight frames. Based on the output image data ODAT, the data driver 130 may provide the data signals DS to the first partial region PR1 at the normal driving frequency NDF of about 120 Hz, and may provide the data signals DS to the second partial region PR2 at the low frequency LF of about 15 Hz. Further, the scan driver 140 may provide the scan signals SS to the first partial region PR1 at the normal driving frequency NDF of about 120 Hz, and may provide the scan signals SS to the second partial region PR2 at the low frequency LF of about 15 Hz. Accordingly, the first partial region PR1 may be driven at the normal driving frequency NDF of about 120 Hz, and the second partial region PR2 may be driven at the low frequency LF of about 15 Hz. Although FIG. 3 illustrates an example where the normal driving frequency NDF is about 120 Hz and the low frequency LF is about 15 Hz, the normal driving frequency NDF and the low frequency LF are not limited to the example of FIG. 3.

In a case where the normal frequency driving operation and the low frequency driving operation are respectively performed on the first partial region PR1 and the second partial region PR2, or in a case where the first partial region PR1 and the second partial region PR2 are driven at the different driving frequencies NDF and LF, a driving transistor of each pixel PX in the first partial region PR1 and a driving transistor of each pixel PX in the second partial region PR2 may receive different stresses. Thus, by the different stresses, a hysteresis deviation or a driving characteristic deviation between the driving transistors of the pixels PX in the first and second partial regions PR1 and PR2 may increase as a time during which the first and second partial regions PR1 and PR2 are driven at the different driving frequencies NDF and LF increases. Thereafter, even if the entire display region DR of the display panel 110 is driven at the same driving frequency to display an image having the same gray level, a boundary between the first and second partial regions PR1 and PR2 may be viewed or perceived by a user.

However, as illustrated in FIG. 2, in a standby mode after the normal frequency driving operation and the low frequency driving operation are performed on the first partial region PR1 and the second partial region PR2, respectively, the panel driver 120 of the display device 100 according to embodiments may set a portion of the second partial region PR2 adjacent to the first partial region PR1 as an adjacent region AR, may performs the low frequency driving operation on the first partial region PR1 and the second partial region PR2' except for the adjacent region AR, and may perform a variable frequency driving operation on the adjacent region AR. In some embodiments, the standby mode may be, but not be limited to, an always on display (AOD) mode or a mode in which a black image is displayed. For example, in the standby mode, the panel driver 120 may drive the first partial region PR1 and the second partial region PR2' except for the adjacent region AR at the low frequency LF, and may drive the adjacent region AR at a variable frequency VF that gradually decreases from the normal driving frequency NDF to the low frequency LF along a direction from the first partial region PR1 that has previously displayed the moving image to the second partial region PR2 that has previously displayed the still image. In some embodiments, in response to the mode signal SMODE indicating the standby mode, the driving frequency decider 170 of the panel driver 120 may set the portion of the second partial region PR2 adjacent to the first partial region PR1 as the adjacent region AR, may determine a driving frequency for the first partial region PR1 and the second partial region PR2' except for the adjacent region AR as the low frequency LF, and may determine a driving frequency for the adjacent region AR as the variable frequency VF that gradually decreases from the normal driving frequency NDF to the low frequency LF along the direction from the first partial region PR1 to the second partial region PR2.

In some embodiments, the driving frequency decider 170 may determine the variable frequency VF for the adjacent region AR such that the variable frequency VF decreases per a pixel row of the adjacent region AR. For example, as illustrated in FIG. 4, in a case where the normal driving frequency NDF is about 120 Hz, the low frequency LF is about 1 Hz, and the adjacent region AR includes ten pixel rows, or first, second, third, fourth, fifth, sixth, seventh, eighth, ninth and tenth pixel rows PXR1, PXR2, PXR3, PXR4, PXR5, PXR6, PXR7, PXR8, PXR9, and PXR10, the panel driver 120 may drive the first pixel row PXR1 closest to the first partial region PR1 at about 120 Hz, may drive the second pixel row PXR2 at about 60 Hz, may drive the third pixel row PXR3 at about 40 Hz, may drive the fourth pixel row PXR4 at about 30 Hz, may drive the fifth pixel row PXR5 at about 20 Hz, may drive the sixth pixel row PXR6 at about 12 Hz, may drive the seventh pixel row PXR7 at about 6 Hz, may drive the eighth pixel row PXR8 at about 3 Hz, may drive the ninth pixel row PXR9 at about 2 Hz, and may drive the tenth pixel row PXR10 farthest from the first partial region PR1 at about 1 Hz. Thus, the variable frequency VF may gradually decrease from the normal driving frequency NDF of about 120 Hz to the low frequency LF of about 1 Hz per each pixel row PXR1, PXR2, PXR3, PXR4, PXR5, PXR6, PXR7, PXR8, PXR9, and PXR10 of the adjacent region AR. Although FIG. 4 illustrates an example of the normal driving frequency NDF, the low frequency LF and the variable frequency VF, the normal driving frequency NDF, the low frequency LF and the variable frequency VF are not limited to the example of FIG. 4.

In other embodiments, the driving frequency decider 170 may determine the variable frequency VF for the adjacent region AR such that the variable frequency VF decreases per N pixel rows of the adjacent region AR, where N is an integer greater than 0. For example, as illustrated in FIG. 5, in a case where the normal driving frequency NDF is about 120 Hz, the low frequency LF is about 1 Hz, and the adjacent region AR includes ten pixel rows, or first, second, third, fourth, fifth, sixth, seventh, eighth, ninth and tenth pixel rows PXR1, PXR2, PXR3, PXR4, PXR5, PXR6, PXR7, PXR8, PXR9 and PXR10, the panel driver 120 may drive the first and second pixel rows PXR1 and PXR2 closest to the first partial region PR1 at about 120 Hz, may drive the third and fourth pixel rows PXR3 and PXR4 at about 40 Hz, may drive the fifth and sixth pixel rows PXR5 and PXR6 at about 20 Hz, may drive the seventh and eighth pixel rows PXR7 and PXR8 at about 6 Hz, and may drive the ninth and tenth pixel rows PXR9 and PXR10 farthest from the first partial region PR1 at about 2 Hz. Thus, the variable frequency VF may gradually decrease from the normal driving frequency NDF of about 120 Hz to the low frequency LF of about 1 Hz per two or more pixel rows PXR1, PXR2, PXR3, PXR4, PXR5, PXR6, PXR7, PXR8, PXR9 and PXR10 of the adjacent region AR. Although FIG. 5 illustrates an example of the normal driving frequency NDF, the low frequency LF and the variable frequency VF, the normal driving frequency NDF, the low frequency LF and the variable frequency VF are not limited to the example of FIG. 5.

Further, although FIGS. 4 and 5 illustrate examples where the adjacent region AR has a size corresponding to the ten pixel rows PXR1, PXR2, PXR3, PXR4, PXR5, PXR6, PXR7, PXR8, PXR9 and PXR10, or a size corresponding to rows of the pixels PX coupled to ten scan lines, the size of the adjacent region AR is not limited to the examples of FIGS. 4 and 5.

In some embodiments, the driving frequency decider 170 of the panel driver 120 may determine the size of the adjacent region AR based on the adjacent region size parameter ARSP representing the number of pixel rows or scan lines of the adjacent region AR. Further, in some embodiments, the controller 150 of the panel driver 120 may store the adjacent region size parameter ARSP, and the adjacent region size parameter ARSP stored in the controller 150 may be updated to a new adjacent region size parameter ARSP received from the external host processor.

For example, as illustrated in FIG. 6, the controller 150 of the panel driver 120 may receive frame data FDAT as the input image data IDAT at an input frame frequency of about 120 Hz from the external host processor, or may read the frame data FDAT from a frame memory that stores image data SDAT at a frame frequency of about 120 Hz. The frame data FDAT may include first partial region data PDAT1 for the first partial region PR1, first adjacent region data ARDAT1 for a first portion of the adjacent region AR, second adjacent region data ARDAT2 for a second portion of the adjacent region AR, and second partial region data PDAT2' for the second partial region PR2' except for the adjacent region AR. Further, in a case where the normal driving frequency NDF is about 120 Hz, the first partial region PR1 and the second partial region PR2' except for the adjacent region AR are driven at the low frequency LF of about 15 Hz, and the adjacent region AR is driven at the variable frequency VF including a first variable frequency VF1 of about 60 Hz for the first portion of the adjacent region AR and a second variable frequency VF2 of about 30 Hz for the second portion of the adjacent region AR, the controller 150 of the panel driver 120 may output the first partial region data PDAT1 and the second partial region data PDAT2' at about 15 Hz, may output the first adjacent region data ARDAT1 at about 60 Hz, and may output the second adjacent region data ARDAT2 at about 30 Hz. Thus, although the controller 150 receives, as the input image data IDAT or the stored image data SDAT, eight frame data FDAT during eight frames, the controller 150 may output the first partial region data PDAT1 and the second partial region data PDAT2' one time during the eight frames, may output the first adjacent region data ARDAT1 four times during the eight frames, and may output the second adjacent region data ARDAT2 two times during the eight frames. Based on the output image data ODAT, the data driver 130 may provide the data signals DS to the first partial region PR1 and the second partial region PR2' except for the adjacent region AR at about 15 Hz, may provide the data signals DS to the first portion of the adjacent region AR at about 60 Hz, and may provide the data signals DS to the second portion of the adjacent region AR at about 30 Hz. Further, the scan driver 140 may provide the scan signals SS to the first partial region PR1 and the second partial region PR2' except for the adjacent region AR at about 15 Hz, may provide the scan signals SS to the first portion of the adjacent region AR at about 60 Hz, and may provide the scan signals SS to the second portion of the adjacent region AR at about 30 Hz. Accordingly, the first partial region PR1 and the second partial region PR2' except for the adjacent region AR may be driven at the low frequency LF of about 15 Hz, and the adjacent region AR may be driven at the variable frequency VF that gradually decreases from the normal driving frequency NDF of about 120 Hz to the low frequency LF of about 15 Hz. Although FIG. 6 illustrates an example of the normal driving frequency NDF, the low frequency LF and the variable frequency VF, the normal driving frequency NDF, the low frequency LF and the variable frequency VF are not limited to the example of FIG. 6.

As described above, in the display device 100 according to embodiments, in the standby mode after the normal frequency driving operation and the low frequency driving operation are performed on the first partial region PR1 and the second partial region PR2, respectively, the portion of the second partial region PR2 adjacent to the first partial region PR1 may be set the adjacent region AR, and the variable frequency driving operation may be performed on the adjacent region AR. That is, the adjacent region AR may be driven at the variable frequency VF that gradually decreases from the normal driving frequency NDF to the low frequency LF along the direction from the first partial region PR1 that has previously displayed the moving image to the second partial region PR2 that has previously displayed the still image. Accordingly, driving characteristics of driving transistors of the pixels PX in the adjacent region AR may be gradually changed along the direction from the first partial region PR1 to the second partial region PR2, the driving transistors of the pixels PX in the adjacent region AR close to the first partial region PR1 may have the driving characteristics similar to driving characteristics of driving transistors of the pixels PX in the first partial region PR1, and the driving transistors of the pixels PX in the adjacent region AR farthest from the first partial region PR1 may have the driving characteristics similar to driving characteristics of driving transistors of the pixels PX in the second partial region PR2' except for the adjacent region AR. Accordingly, the boundary between the first partial region PR1 and the second partial region PR2 may be prevented from being viewed or perceived by the user.

In some embodiments, a time length of a second time T2 during which the variable frequency driving operation is performed on the adjacent region AR may be substantially the same as a time length of a first time T1 during which the normal frequency driving operation and the low frequency driving operation are respectively performed on the first partial region PR1 and the second partial region PR2. To perform the variable frequency driving operation on the adjacent region AR during the second time T2 having substantially the same time length as the first time T1, the panel driver 120 may further include a counter 180 that increases a count value CV from an initial value (e.g., zero) for the first time T1 during which the normal frequency driving operation and the low frequency driving operation are respectively performed on the first partial region PR1 and the second partial region PR2. Further, the counter 180 may decrease the count value CV increased for the first time T1 to the initial value in the standby mode. In the standby mode, the panel driver 120 may perform the variable frequency driving operation on the adjacent region AR until the count value CV reaches the initial value, and may perform the low frequency driving operation on the entire display region DR of a display panel 110*e* as illustrated in FIG. 2 after the count value CV reaches the initial value. Thus, if the count value CV becomes the initial value in the standby mode, the panel driver 120 may drive the entire display region DR of the display panel 110*e* at the low frequency LF.

Further, in some embodiments, the counter 180 may stop decreasing the count value CV when the standby mode is exited before the count value CV increased for the first time T1 reaches the initial value, and may resume decreasing the count value CV when the standby mode is re-entered. Accordingly, even if the standby mode continues for a time shorter than the first time T1, the variable frequency driving operation for the adjacent region AR may be performed in the next standby mode, and thus the time length of the second time T2 during which the variable frequency driving operation is performed on the adjacent region AR may be substantially the same as the time length of the first time T1 during which the first and second partial regions PR1 and PR2 are driven at the different driving frequencies NDF and LF.

Figure 7:
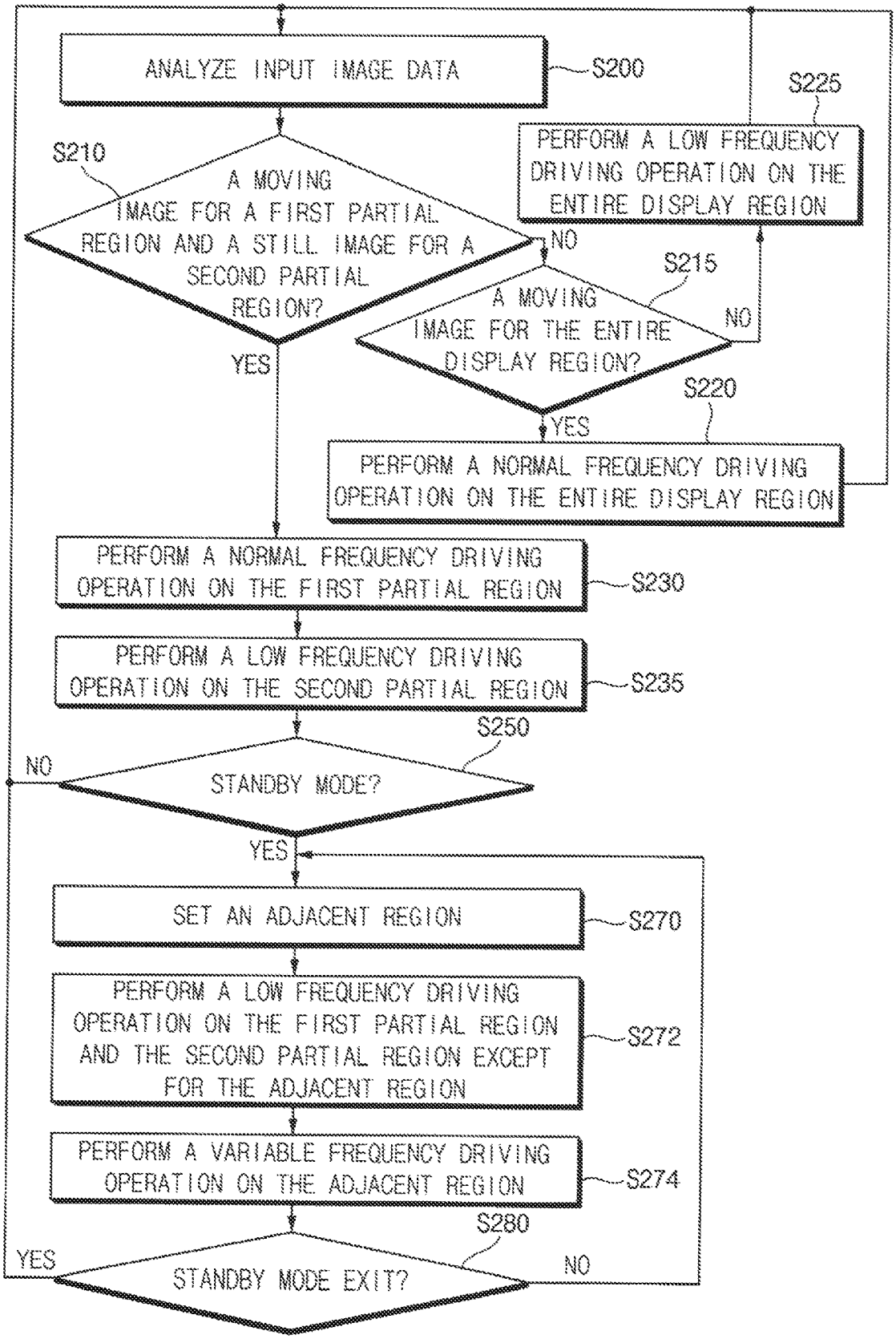
FIG. 7 is a flowchart illustrating a method of operating a display device according to embodiments.

FIG. 7 is a flowchart illustrating a method of operating a display device according to embodiments.

Referring to FIGS. 1 and 7, in a method of operating a display device 100 according to embodiments, a panel driver 120 may detect a still image in an image represented by input image data IDAT by analyzing the input image data IDAT (S200).

In a case where the input image data IDAT represent a moving image with respect to the entire display region DR of a display panel 110 (S210: NO and S215: YES), the panel driver 120 may perform a normal frequency driving operation on the entire display region DR of the display panel 110

(S220). Thus, the panel driver 120 may drive the entire display region DR of the display panel 110 at a normal driving frequency.

Further, in a case where the input image data IDAT represent a still image with respect to the entire display region DR of the display panel 110 (S210: NO and S215: NO), the panel driver 120 may perform a low frequency driving operation on the entire display region DR of the display panel 110 (S225). Thus, the panel driver 120 may drive the entire display region DR of the display panel 110 at a low frequency lower than the normal driving frequency.

Alternatively, in a case where the input image data IDAT represent the moving image with respect to a first partial region of the display panel 110 and represent the still image with respect to a second partial region of the display panel 110 (S210: YES), the panel driver 120 may perform the normal frequency driving operation on the first partial region displaying the moving image (S230), and may perform the low frequency driving operation on the second partial region displaying the still image (S235). Thus, the panel driver 120 may drive the first partial region of the display panel 110 at the normal driving frequency, and may drive the second partial region of the display panel 110 at the low frequency lower than the normal driving frequency. If the first and second partial regions are driven at different driving frequencies, driving transistors of pixels PX in the first and second partial regions may have a hysteresis deviation or a driving characteristic deviation. Further, in a normal mode (S250: NO), the normal frequency driving operation and/or the low frequency driving operation may be repeated (S200 through S235).

In a standby mode after the normal frequency driving operation and the low frequency driving operation are performed on the first partial region and the second partial region, respectively (S250: YES), the panel driver 120 may set a portion of the second partial region adjacent to the first partial region as an adjacent region (S270), may perform the low frequency driving operation on the first partial region and the second partial region except for the adjacent region (S272), and may perform a variable frequency driving operation on the adjacent region (S274). Thus, the panel driver 120 may drive the first partial region and the second partial region except for the adjacent region at the low frequency lower than the normal driving frequency, and may drive the adjacent region at a variable frequency that gradually decreases from the normal driving frequency to the low frequency along a direction from the first partial region to the second partial region. Accordingly, driving characteristics of driving transistors of the pixels PX in the adjacent region may be gradually changed along the direction from the first partial region to the second partial region, and a boundary between the first partial region and the second partial region may be prevented from being viewed or perceived by a user.

In some embodiments, in a case where the standby mode is not exited (S280: NO), the low frequency driving operation for the first partial region and the second partial region except for the adjacent region, and the variable frequency driving operation for the adjacent region may be repeated (e.g., for a predetermined time or for a time substantially the same as a time during which the first and second partial regions are driven at the different driving frequencies) (S270 through S274). Thereafter, if the standby mode is exited (S280: YES), the normal frequency driving operation and/or the low frequency driving operation may be performed (S200 through S235).

As described above, in the method of operating the display device 100 according to embodiments, in the standby mode after the normal frequency driving operation and the low frequency driving operation are performed on the first partial region and the second partial region, respectively, the portion of the second partial region adjacent to the first partial region may be set as the adjacent region, the low frequency driving operation may be performed on the first partial region and the second partial region except for the adjacent region, and the variable frequency driving operation may be performed on the adjacent region. Accordingly, even if the first and second partial regions are driven at the different driving frequencies, the boundary between the first and second partial regions may be prevented from being viewed or perceived by the user.

Figure 8A:
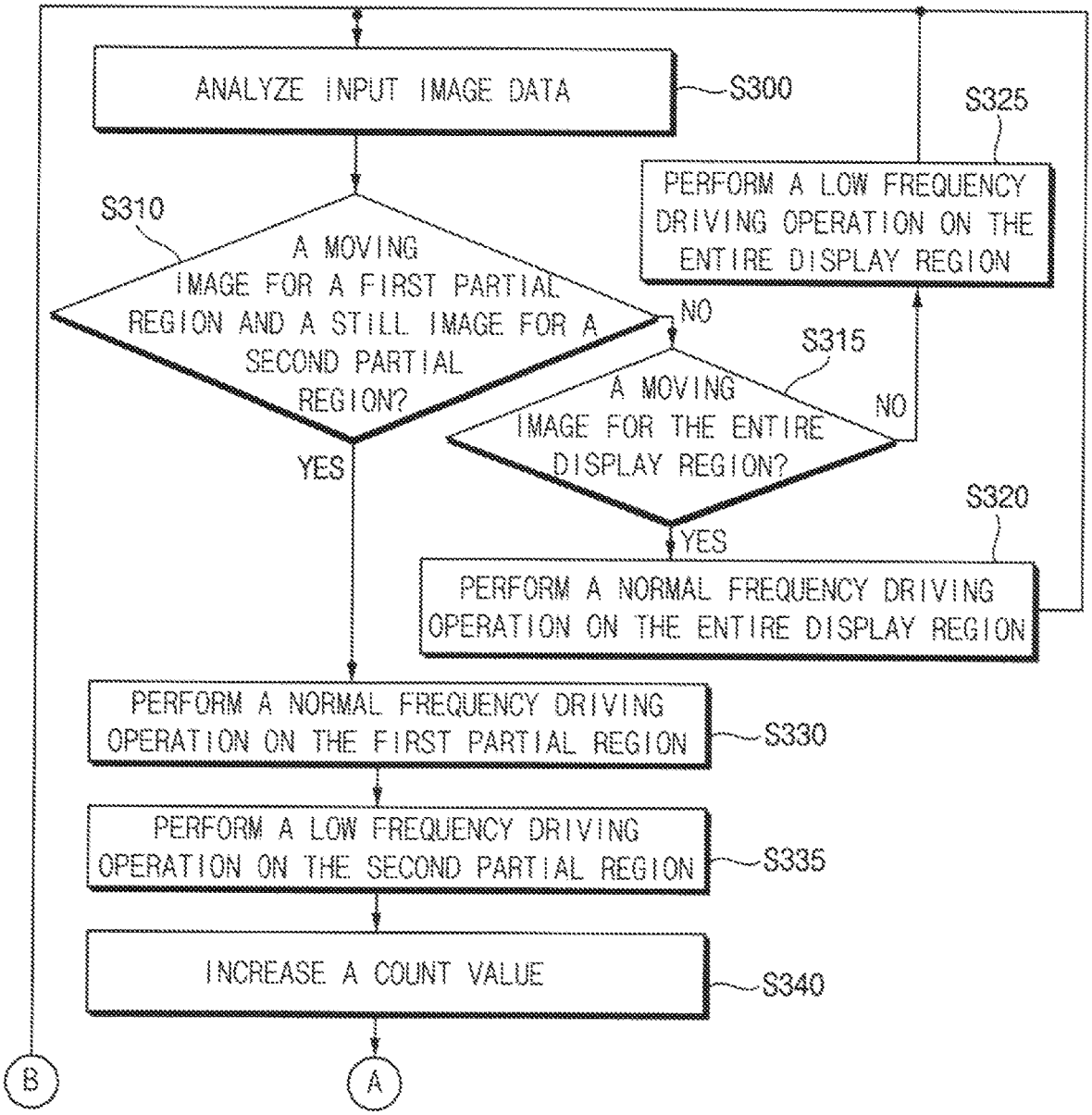
FIGS. 8A and 8B are a flowchart illustrating a method of operating a display device according to embodiments.
Figure 8B:
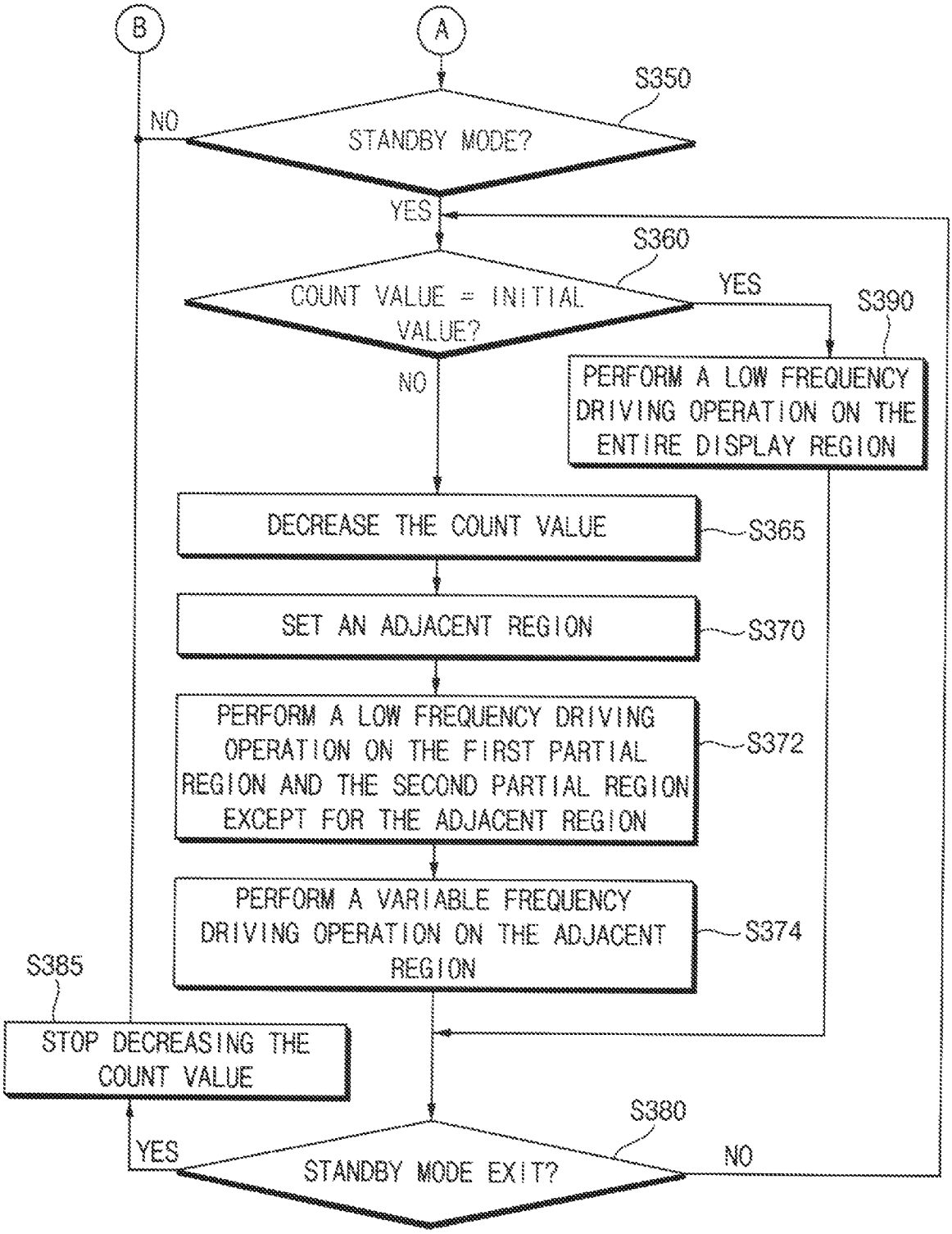

FIGS. 8A and 8B are a flowchart illustrating a method of operating a display device according to embodiments.

Referring to FIGS. 1, 8A and 8B, in a method of operating a display device 100 according to embodiments, a panel driver 120 may detect a still image in an image represented by input image data IDAT by analyzing the input image data IDAT (S300). In a case where the input image data IDAT represent a moving image with respect to the entire display region DR of a display panel 110 (S310: NO and S315: YES), the panel driver 120 may perform a normal frequency driving operation on the entire display region DR of the display panel 110 (S320). Further, in a case where the input image data IDAT represent a still image with respect to the entire display region DR of the display panel 110 (S310: NO and S315: NO), the panel driver 120 may perform a low frequency driving operation on the entire display region DR of the display panel 110 (S325).

Alternatively, in a case where the input image data IDAT represent the moving image with respect to a first partial region of the display panel 110 and represent the still image with respect to a second partial region of the display panel 110 (S310: YES), the panel driver 120 may perform the normal frequency driving operation on the first partial region displaying the moving image (S330), and may perform the low frequency driving operation on the second partial region displaying the still image (S335). Further, a counter 180 of the panel driver 120 may increase a count value CV from an initial value for a first time during which the normal frequency driving operation and the low frequency driving operation are respectively performed on the first partial region and the second partial region (S340). In a normal mode (S350: NO), the normal frequency driving operation and/or the low frequency driving operation may be repeated (S300 through S340).

In a standby mode after the normal frequency driving operation and the low frequency driving operation are performed on the first partial region and the second partial region, respectively (S350: YES), while the count value CV is greater than the initial value (S360: NO), the panel driver 120 may decrease the count value CV increased for the first time (S365), may set a portion of the second partial region adjacent to the first partial region as an adjacent region (S370), may perform the low frequency driving operation on the first partial region and the second partial region except for the adjacent region (S372), and may perform a variable frequency driving operation on the adjacent region (S374). In a case where the standby mode is not exited (S380: NO), decreasing the count value CV, the low frequency driving operation for the first partial region and the second partial region except for the adjacent region, and the variable frequency driving operation for the adjacent region may be repeated (S360 through S374).

If the count value CV reaches the initial value (S360: YES), the panel driver 120 may finish the variable frequency driving operation for the adjacent region, and may perform the low frequency driving operation on the entire display region DR of the display panel 110 (S390). As described above, since the count value CV is increased from the initial value for the first time, and the variable frequency driving operation is performed for a second time during which the count value CV is decreased to the initial value, a time length of the second time during which the variable frequency driving operation is performed on the adjacent region may be substantially the same as a time length of the first time during which the normal frequency driving operation and the low frequency driving operation are respectively performed on the first partial region and the second partial region.

In some embodiments, when the standby mode is exited before the count value CV increased for the first time reaches the initial value (S380: YES), the panel driver 120 may stop decreasing the count value CV (S385). Further, when the standby mode is re-entered after decreasing the count value CV is stopped, the panel driver 120 may resume decreasing the count value CV. Accordingly, even if the standby mode continues for a time shorter than the first time, the variable frequency driving operation for the adjacent region may be performed in the next standby mode, and thus the time length of the second time during which the variable frequency driving operation is performed on the adjacent region may be substantially the same as the time length of the first time during which the first and second partial regions are driven at the different driving frequencies.

As described above, in the method of operating the display device 100 according to embodiments, in the standby mode after the normal frequency driving operation and the low frequency driving operation are performed on the first partial region and the second partial region, respectively, the portion of the second partial region adjacent to the first partial region may be set as the adjacent region, the low frequency driving operation may be performed on the first partial region and the second partial region except for the adjacent region, and the variable frequency driving operation may be performed on the adjacent region. Accordingly, even if the first and second partial regions are driven at the different driving frequencies, a boundary between the first and second partial regions may be prevented from being viewed or perceived by a user.

Figure 9:
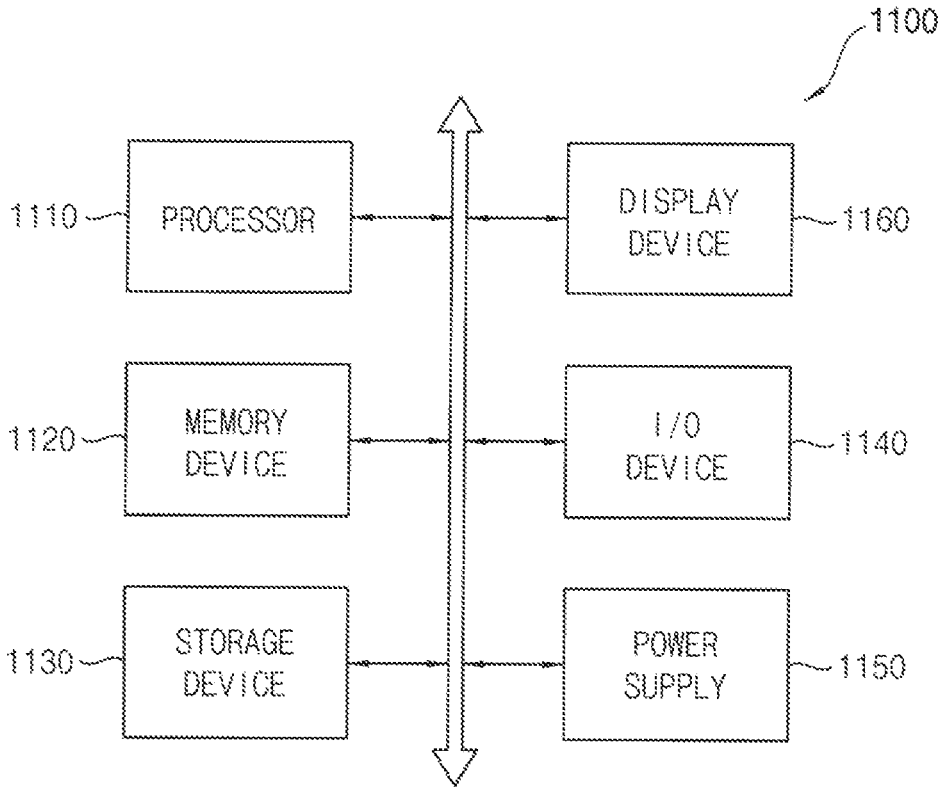
FIG. 9 is a block diagram illustrating an electronic device including a display device according to embodiments.

FIG. 9 is a block diagram illustrating an electronic device including a display device according to embodiments.

Referring to FIG. 9, an electronic device 1100 may include a processor 1110, a memory device 1120, a storage device 1130, an input/output (I/O) device 1140, a power supply 1150, and a display device 1160. The electronic device 1100 may further include a plurality of ports for communicating with a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device, in a standby mode after a normal frequency driving operation and a low frequency driving operation are performed on a first partial region and a second partial region, respectively, a portion of the second partial region adjacent to the first partial region may be set as an adjacent region, the low frequency driving operation may be performed on the first partial region and the second partial region except for the adjacent region, and a variable frequency driving operation may be performed on the adjacent region. Accordingly, even if the first and second partial regions are driven at different driving frequencies, a boundary between the first and second partial regions may be prevented from being viewed or perceived by a user.

The present disclosure may be applied to any display device 1160, and any electronic device 1100 including the display device 1160. For example, the present disclosure may be applied to a mobile phone, a smart phone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A display device comprising:

a display panel having a display region; and a panel driver configured to drive the display panel based on input image data, wherein, when the input image data represents a moving image with respect to a first partial region of the display region and represents a still image with respect to a second partial region of the display region, the panel driver performs a normal frequency driving operation on the first partial region, and performs a low frequency driving operation on the second partial region, and wherein, in a standby mode, after the normal frequency driving operation and the low frequency driving operation are performed on the first partial region and the second partial region, respectively, the panel driver sets a portion of the second partial region adjacent to the first partial region as an adjacent region, performs the low frequency driving operation on the first partial region and the second partial region except for the adjacent region, and performs a variable frequency driving operation on the adjacent region.

2. The display device of claim 1, wherein the variable frequency driving operation for the adjacent region drives the adjacent region at a variable frequency that gradually decreases from a normal driving frequency to a low frequency along a direction from the first partial region to the second partial region.

3. The display device of claim 2, wherein the variable frequency decreases per a pixel row of the adjacent region.

4. The display device of claim 2, wherein the variable frequency decreases per N pixel rows of the adjacent region, where N is an integer greater than 0.

5. The display device of claim 1, wherein the normal frequency driving operation for the first partial region drives the first partial region at a normal driving frequency, wherein the low frequency driving operation for the second partial region drives the second partial region at a low frequency lower than the normal driving frequency, and wherein the low frequency driving operation for the first partial region and the second partial region except for the adjacent region drives the first partial region and the second partial region except for the adjacent region at the low frequency.

6. The display device of claim 1, wherein a size of the adjacent region is determined based on an adjacent region size parameter.

7. The display device of claim 1, wherein the standby mode is an always on display (AOD) mode or a mode in which a black image is displayed.

8. The display device of claim 1, wherein the panel driver includes:

a still image detector configured to detect the still image in an image represented by the input image data by analyzing the input image data.

9. The display device of claim 8, wherein the panel driver further includes:

a driving frequency decider configured to determine a driving frequency for the first partial region determined by the still image detector to display the moving image as a normal driving frequency, and to determine a driving frequency for the second partial region determined by the still image detector to display the still image as a low frequency lower than the normal driving frequency.

10. The display device of claim 9, wherein, in the standby mode, the driving frequency decider sets the portion of the second partial region adjacent to the first partial region as the adjacent region, determines a driving frequency for the first partial region and the second partial region except for the adjacent region as the low frequency, and determines a driving frequency for the adjacent region as a variable frequency that gradually decreases from the normal driving frequency to the low frequency along a direction from the first partial region to the second partial region.

11. The display device of claim 1, wherein a time length of a second time during which the variable frequency driving operation is performed on the adjacent region is substantially equal to a time length of a first time during which the normal frequency driving operation and the low frequency driving operation are respectively performed on the first partial region and the second partial region.

12. The display device of claim 1, wherein the panel driver includes:

a counter configured to increase a count value from an initial value for a first time during which the normal frequency driving operation and the low frequency driving operation are respectively performed on the first partial region and the second partial region.

13. The display device of claim 12, wherein the counter decreases the count value increased for the first time to the initial value in the standby mode, and wherein, in the standby mode, the panel driver performs the variable frequency driving operation on the adjacent region until the count value reaches the initial value, and performs the low frequency driving operation on an entire region of the display region after the count value reaches the initial value.

14. The display device of claim 13, wherein the counter stops decreasing the count value when the standby mode is exited before the count value increased for the first time reaches the initial value, and resumes decreasing the count value when the standby mode is re-entered.

15. A method of operating a display device including a display panel having a display region, the method comprising steps of:

performing a normal frequency driving operation on a first partial region of the display region when input image data represents a moving image with respect to the first partial region;

performing a low frequency driving operation on a second partial region of the display region when the input image data represents a still image with respect to the second partial region;

setting a portion of the second partial region adjacent to the first partial region as an adjacent region in a standby mode after the normal frequency driving operation and the low frequency driving operation are performed on the first partial region and the second partial region, respectively;

performing the low frequency driving operation on the first partial region and the second partial region except for the adjacent region in the standby mode; and performing a variable frequency driving operation on the adjacent region in the standby mode.

16. The method of claim 15, wherein performing the variable frequency driving operation on the adjacent region is accomplished by driving the adjacent region at a variable frequency that gradually decreases from a normal driving frequency to a low frequency along a direction from the first partial region to the second partial region.

17. The method of claim 15, wherein performing the normal frequency driving operation on the first partial region is accomplished by driving the first partial region at a normal driving frequency, wherein performing the low frequency driving operation on the second partial region is accomplished by driving the second partial region at a low frequency lower than the normal driving frequency, and wherein performing the low frequency driving operation on the first partial region and the second partial region except for the adjacent region is accomplished by driving the first partial region and the second partial region except for the adjacent region at the low frequency.

18. The method of claim 15, wherein a time length of a second time during which the variable frequency driving operation is performed on the adjacent region is substantially equal to a time length of a first time during which the normal frequency driving operation and the low frequency driving operation are respectively performed on the first partial region and the second partial region.

19. The method of claim 15, further comprising steps of:

increasing a count value from an initial value for a first time during which the normal frequency driving operation and the low frequency driving operation are respectively performed on the first partial region and the second partial region; and decreasing the count value increased for the first time to the initial value in the standby mode, wherein the variable frequency driving operation for the adjacent region is performed until the count value reaches the initial value.

20. The method of claim 19, wherein decreasing the count value to the initial value is accomplished by stopping decreasing the count value when the standby mode is exited before the count value increased for the first time reaches the initial value, and resuming decreasing the count value when the standby mode is re-entered.

* * * * *